US005673490A

United States Patent [19]

Hill

[11] Patent Number: 5,673,490

[45] Date of Patent: Oct. 7, 1997

[54] ALIGNMENT MECHANISM

[76] Inventor: Kerry Jean Hill, 3766 S. 250 West, Bountiful, Utah 84010

[21] Appl. No.: 574,576

[22] Filed: Dec. 14, 1995

Related U.S. Application Data

[63] Continuation of Ser. No. 226,005, Apr. 8, 1994, abandoned.

[51] Int. Cl.[6] ..... B42D 15/00

[52] U.S. Cl. ..... 33/1 G; 33/1 K; 33/1 B; 33/566

[58] Field of Search ..... 33/1 G, 1 K, 1 B, 33/1 C, 1 F, 1 AA, 616, 566; 283/115; 434/88, 90; 362/97

[56] References Cited

U.S. PATENT DOCUMENTS

| | | | |
|---|---|---|---|
| 752,617 | 2/1904 | De Pue | 33/1 B |
| 865,418 | 9/1907 | Moe | 33/1 C |
| 2,034,529 | 3/1936 | Olsen | 33/616 X |
| 2,225,903 | 12/1940 | Chaix | 33/1 AA |
| 2,497,360 | 2/1950 | Justice | 434/90 |
| 3,802,102 | 4/1974 | Licciardi | 362/97 X |
| 3,924,879 | 12/1975 | Wright . | |
| 4,001,941 | 1/1977 | Cruz | 33/1 K |
| 4,559,705 | 12/1985 | Hodge et al. | 33/1 B |
| 4,779,346 | 10/1988 | Schafer | 33/1 B |
| 4,865,547 | 9/1989 | Glover | 434/90 |
| 5,016,357 | 5/1991 | Leonard | 33/1 K |
| 5,174,037 | 12/1992 | Curtin | 33/1 B X |

FOREIGN PATENT DOCUMENTS

| | | | |
|---|---|---|---|
| 2600283 | 12/1987 | France | 33/1 K |
| 8354 | 10/1899 | Norway | 434/90 |

OTHER PUBLICATIONS

Ken's Gun Room Catalog, 1991, pp. 485, 488, 493, 494 no month.

*Primary Examiner*—Thomas B. Will
*Attorney, Agent, or Firm*—Thorpe, North & Western, L.L.P.

[57] ABSTRACT

An alignment mechanism and method for using the same are disclosed in which the alignment mechanism includes a sheet of translucent (including transparent) material with a plurality of horizontal and vertical intersecting traces positioned to form a grid. In a preferred embodiment, the sheet of translucent material is made of static cling vinyl to allow the sheet to hold itself to glass and other smooth surfaces. The sheet of material can also include centered X and Y axes to enable the user to determine the center of the sheet—thereby allowing the user to appropriately position art works relative to one another without relying on unaided perception.

10 Claims, 2 Drawing Sheets

ALIGNMENT MECHANISM

This application is a continuation of U.S. application Ser. No. 08/226,005 filed Apr. 8, 1994, of KERRY J. HILL for ALIGNMENT MECHANISM now abandoned.

BACKGROUND OF THE INVENTION

The present invention relates to an alignment mechanism for use with art projects and in particular to a card having a grid system printed on static cling vinyl or similar material to aid in the positioning, tracing and alignment of art projects when using a light box or other light source.

The use of art boxes has become well known in several areas of art and craft design.

A good example of a craft in which light boxes are used is the custom embossing of greeting and other cards. Typically, a small piece of brass (usually 0.016 inches thick) is formed in the shape which the user desires to emboss on the card. The brass is then placed on the top of the light box and the card is placed over the brass. Pressing on the card causes the design of the brass to be embossed (or raised) on the card.

A primary disadvantage of current light boxes is that they lack any method for centering the brass relative to the desired position on the card. Thus, the user typically must rely on his or her own perception to determine if the embossed design will be properly positioned. Such an arrangement leads to many errors and the user often must start over with a new card—the old card being discarded.

A like situation arises when the light box is used to trace characters or other drawings. If several different characters or drawings are to be placed on the same sheet of paper, it is often difficult to determine the proper positioning of the designs with respect to one another.

This problem is not limited to light boxes alone. Some artists and craft makers use a window and allow the natural light to illuminate their working medium. However, as with light boxes, it is difficult to tell if the design is properly centered and even horizontally and vertically. With vertically positioned windows, the problem is particularly troublesome in that momentarily release of either the design to be traced or the paper onto which it will be traced causes the relative alignment of the two to be lost.

Thus, there is a need for an alignment mechanism to aid in the alignment of art work or crafts so that they are properly positioned.

SUMMARY OF THE INVENTION

It is an object of the present invention to provide an alignment mechanism for use with art projects and other crafts.

It is an additional object of the invention to provide an alignment mechanism having a cross hair to assist in the positioning of art works and crafts when using a light box or analogous light source.

It is another object of the invention to provide an alignment mechanism which will cling to a light box to assist in centering the art projects.

The above, and other objects of the invention, are achieved in an alignment mechanism having a grid system consisting of a sheet of translucent or transparent material having a plurality of spaced, generally horizontal traces intersected by a plurality of spaced, generally vertical traces. An X axis and a Y axis is provided by a horizontal trace bisected by a vertical trace positioned at the center of the mechanism, the center traces being formed so as to be distinguishable from the other horizontal and vertical traces, respectively.

In accordance with one aspect of the invention, the horizontal and vertical traces are numbered so as to assist the user in determining the distance of the given object from center, or any other place on the alignment mechanism.

In accordance with another aspect of the invention, the sheet of transparent material is made of static cling vinyl for holding the grid system to glass and other smooth surfaces.

BRIEF DESCRIPTION OF THE DRAWINGS

The above, and other objects, features and advantages of the invention, will become apparent from a consideration of the following detailed description presented in connection with the accompanying drawings, in which.

DETAILED DESCRIPTION

Figure 1:
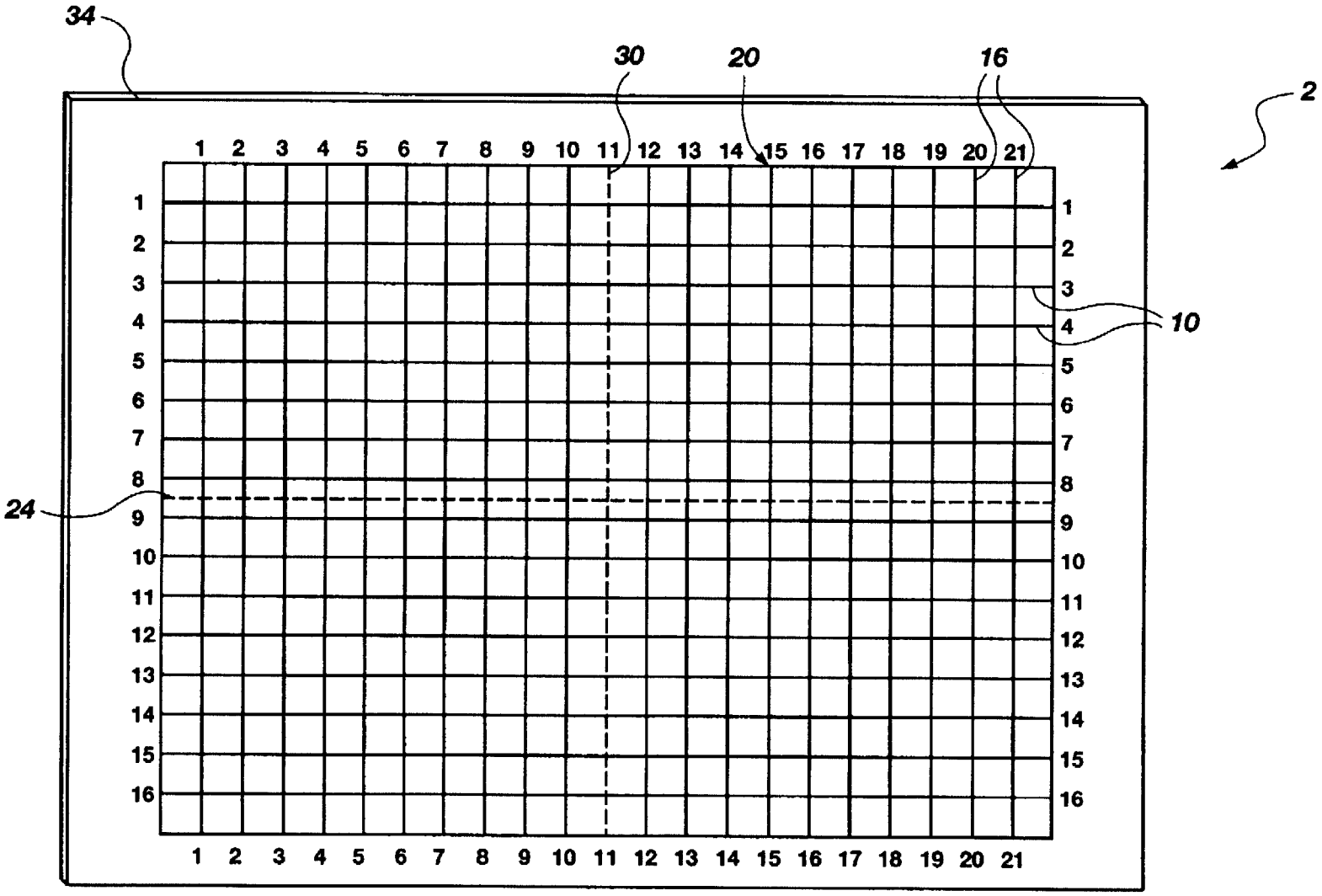
FIG. 1 shows a top view of an alignment mechanism made in accordance with the present invention.

Reference will now be made to the drawings in which the various elements of the present invention will be given numeral designations and in which the invention will be discussed so as to enable one skilled in the art to make and use the invention. Referring to FIG. 1, there is shown an alignment mechanism, generally indicated at 2, comprising a plurality of generally parallel horizontal traces 10 intersected by a plurality of generally parallel vertical traces 16. The horizontal traces 10 are generally distanced evenly from each other, as are the vertical traces 16, so as to create a grid system, generally indicated at 20.

Positioned at the center of the horizontal traces 10 is a center horizontal trace 24 having a distinguishing characteristic so as to differentiate the trace from the other horizontal traces. As shown in FIG. 1, this distinguishing characteristic is made by forming the horizontal trace 24 from a plurality of dashes. Those skilled in the art will recognize that this differentiation could also be accomplished by such things as providing the trace in a different color, or providing the trace with a different thickness than the other horizontal traces 10. However, it is believed that the dashed center horizontal trace 24 is preferable because of the shadow characteristics involved with the use of the light box. Depending on the medium with which one is working, it may be difficult to distinguish between colors, or even between the width of the trace. In contrast, the dashed trace is distinguishable through most materials.

Disposed at the center of the row of vertical traces 16 is a vertical trace 30 which is differentiated from the other vertical traces so as to inform the user of the center point along the horizontal axis (horizontal trace 24) of the alignment mechanism 2. Like the horizontal trace 24, the center vertical trace 30 is distinguished by being formed of a plurality of dashes. Those skilled in the art will recognize that this trace could be distinguished in numerous other ways, as explained, relative to the horizontal trace 24.

The horizontal trace 24 and the vertical trace 30 bisect so as to form an X axis and a Y axis on the alignment mechanism. This enables the user to accurately determine the position of any point on the alignment mechanism 2 with respect to any other point.

In accordance with one aspect of the invention, each trace can be numbered, as demonstrated in FIG. 1, to further assist the user in determining the position and the distance between any two points on the alignment mechanism 2.

Preferably, the grid system 20 is disposed on a sheet of clear static cling vinyl (polyvinyl chloride) 34 or other translucent sheet. Those skilled in the art of printing will be familiar with such vinyls. As used hereafter, translucent shall include transparent or clear materials. The translucent vinyl material 34 or similar material allows light to pass through the alignment mechanism 2 so that the mechanism does not interfere with the appropriate use of the light box. A transparent translucent material 34 also facilitates the use of a window as a light source in that the material causes little disturbance to the intensity of the incoming light.

Of the many translucent, flexible materials which can be used for holding the grid system 20, static cling vinyl is preferred because it will hold temporarily to the glass (or similar) surface while it is being used. Once the user is done, the sheet of static cling vinyl may be easily removed from the glass without leaving sticky spots or other traces.

The exact spacing of the grid system 20 will depend on the size of the light box and the particular art work which will be made thereon. Those skilled in the art will recognize the various spacings which could be used.

Figure 2:
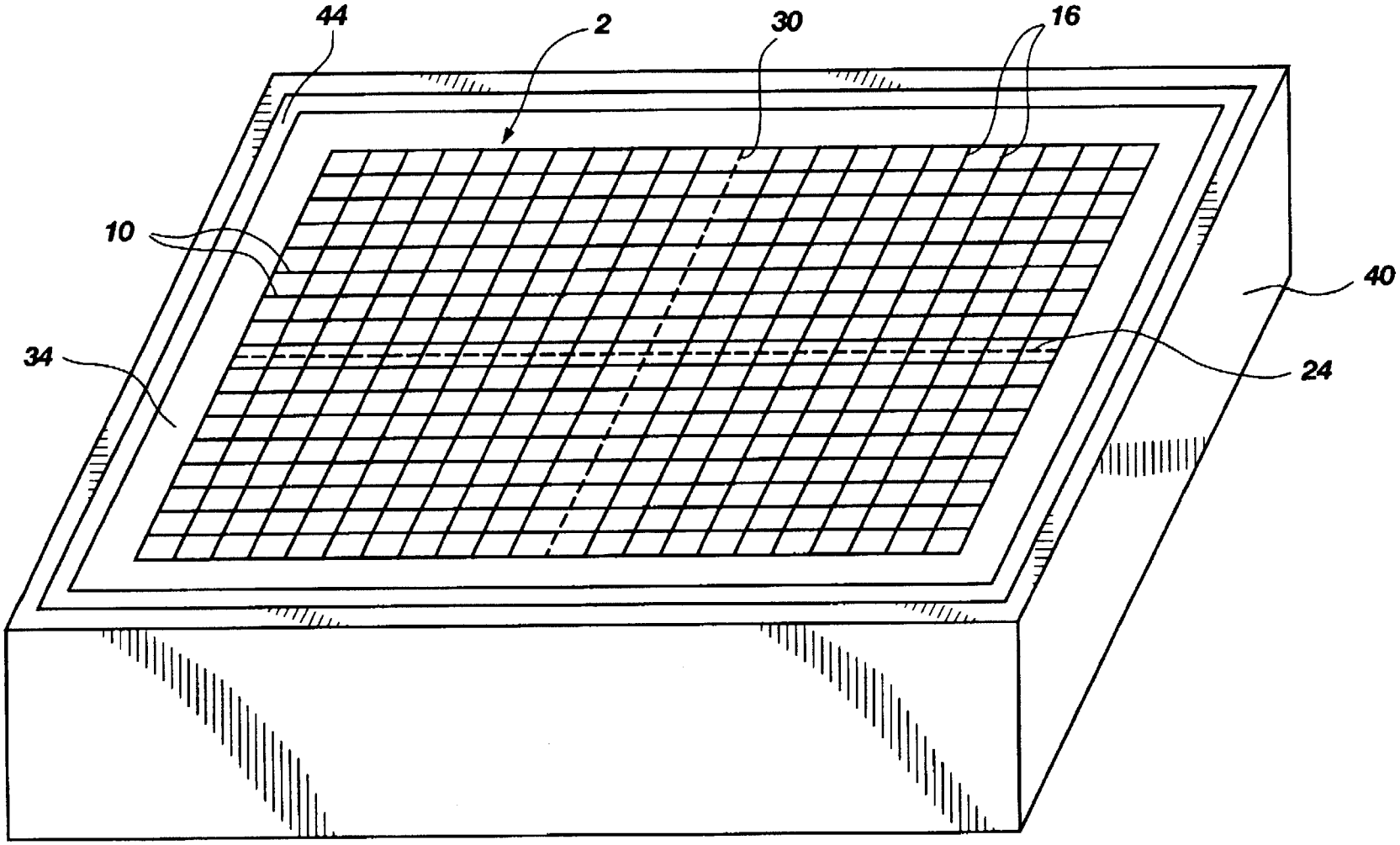
FIG. 2 shows an elevated perspective view of an alignment mechanism as shown in FIG. 1 positioned on a light box so as to enable the user to determine relative positions of items placed on top of the light box.

Referring now to FIG. 2. There is a shown a perspective view of an alignment mechanism 2 as made in accordance with the present invention positioned on a light box 40. The light box 40 includes a generally clear surface, generally indicated at 44, positioned at the top of the light box and a light source (not shown) positioned within the light box. In use, the alignment mechanism 2 is placed upon the glass or other clear surface 44 so as to substantially cover the clear surface. Because the alignment mechanism 2 is formed of static cling vinyl, it will hold to the clear surface 44 rather than sliding.

When embossing paper, the piece of brass (not shown) can be aligned relative to the alignment mechanism 2 so that it will form the desired imprint on the paper—at the correct position. A piece of paper is then laid over the brass and adjusted so that it aligns properly with the alignment mechanism 2 and the brass. Because of the light source (not shown) and the translucent material 34 of the alignment mechanism 2, the position of the brass can usually still be seen through the paper, as can the traces of the alignment mechanism. Once both the brass and the paper are positioned properly, pressure is applied to the paper to emboss the design of the brass into the paper. Thus, the user can be assured that the brass and paper are properly aligned rather than relying on his or her own perceptions.

While discussed primarily with respect to embossing paper using a light box 40, the alignment mechanism 2 is equally useful in other arts and crafts and with other light sources. For example, a person may wish to trace several figures from different sources into a single drawing. The tracings can be made by holding the originals up to a window. However, it is often difficult while drawing to properly perceive the position of each tracing relative to one another. Prior to making the tracings, the alignment mechanism 2 can be placed against the window. If the alignment mechanism 2 uses static cling vinyl, it will hold itself to the window, freeing the hands of the user to make the tracings. If another material is used, a couple of pieces of tape will generally be sufficient to hold the alignment mechanism 2 to the window. The original is sandwiched between the alignment mechanism 2 and the tracing paper. The light passing through the window passes through the alignment mechanism 2 so that the original can be seen and traced. The alignment mechanism 2 thus allows the original and tracing paper to be properly aligned—avoiding the reliance on perspective alone.

In addition to embossing and tracing, the alignment mechanism 2 can be useful for quilting, sewing, design layout and other arts and crafts which use illumination to facilitate copying. Those skilled in the art will recognize other uses and designs for the alignment mechanism 2 without departing from the scope and spirit of the present invention. The appended claims are intended to cover such modifications.

We claim:

1. An alignment mechanism for use with light boxes, the alignment mechanism comprising:

a generally translucent sheet of material for allowing light to pass therethrough, said sheet of translucent material being being formed from a static cling vinyl;

a plurality of generally parallel, vertical traces arranged on the sheet of material, spaced from one another a generally pre-determined distance, substantially all of the vertical lines being continuous; and a plurality of generally parallel horizontal traces formed on the sheet of material intersecting the vertical traces, and spaced from one another a similar generally pre-determined distance as the vertical traces, substantially all of the horizontal traces being continuous, thereby forming a continuous grid to enable a user to determine the position of a point on the grid relative to other points on the grid so as to enable centering of an art/craft work on the light box.

2. The alignment mechanism of claim 1 further comprising a center horizontal trace and a center vertical trace intersecting one another at a central point of the alignment mechanism so as to define an X-axis and a Y-axis of the alignment mechanism.

3. The alignment mechanism of claim 2 wherein the center horizontal trace and the center vertical trace are formed by dashed lines so as to distinguish them visually from the traces comprising the plurality of generally parallel horizontal traces and the plurality of generally parallel vertical traces.

4. The alignment mechanism of claim 2 wherein the center horizontal and vertical traces have a thickness different than that of the traces comprising the plurality of generally parallel horizontal traces and the plurality of generally parallel vertical traces so as to enable a user to visually distinguish the center horizontal and vertical traces from the traces comprising the plurality of generally parallel horizontal traces and the plurality of generally parallel vertical traces.

5. The alignment mechanism of claim 2 wherein the center horizontal and vertical traces comprise a different color than the traces comprising the plurality of generally parallel horizontal traces and the plurality of generally parallel vertical traces so as to visually distinguish the center horizontal and vertical traces from the traces comprising the plurality of generally parallel horizontal traces and the plurality of generally parallel vertical traces.

6. The alignment mechanism of claim 2 wherein the center horizontal trace is disposed at a distance other than the generally pre-determined distance from adjacent horizontal traces.

7. An alignment mechanism for use with light boxes, the alignment mechanism comprising:

a generally clear sheet of static cling vinyl, the sheet of vinyl being generally transparent for allowing light to pass therethrough;

a plurality of continuous vertical traces arranged in a row and spaced from one another a generally predetermined distance, one of the vertical traces disposed in the center of the row being visually distinct from the others such that a user can identify the center trace without counting the number of traces on either side of the center trace;

a plurality of continuous horizontal traces disposed in a column and spaced from one another a generally predetermined distance so as to intersect the vertical traces, thereby forming a continuous intersecting grid of vertical and horizontal traces to enable a user to determine the position of a point on the grid relative to other points on the grid; and a center horizontal trace disposed between a centermost pair of traces comprising the plurality of horizontal traces, the center horizontal trace being visually distinct from each trace comprising the plurality of horizontal traces, the center trace intersecting the center vertical trace so as to passing through an approximate center point of the sheet of vinyl so as to divide the sheet of vinyl into four generally equal quarters.

8. A method for aligning arts and crafts, the method including:

(a) providing a generally translucent surface with a light source disposed on one side of the surface;

(b) placing a sheet of transparent static cling vinyl material having a continuous grid formed thereon with X and Y axes formed of visually distinct traces so as to inform the user of the center of the sheet of material against the surface on the side opposite the light source;

(c) causing light to be emitted from the light source through the grid; and (d) placing a piece of art/craft work adjacent to the sheet of material and aligning the art/craft work relative to the intersecting traces.

9. The method of claim 8 wherein step (a) comprises providing a light box.

10. A method of embossing paper including each of the steps of claim 8, and further comprising:

(e) placing a piece of brass on the sheet of translucent material and aligning the piece of brass relative to the intersecting traces, and (f) placing a piece of paper comprising the art/craft work over the brass and using the intersecting traces to align the paper relative to the piece of brass.

* * * * *